United States Patent [19]

Yamagishi

[11] Patent Number: 4,908,614

[45] Date of Patent: Mar. 13, 1990

[54] IMAGE DATA OUTPUT APPARATUS

[75] Inventor: Tooru Yamagishi, Tokyo, Japan

[73] Assignee: Victor Company of Japan, Ltd., Yokohama, Japan

[21] Appl. No.: 166,237

[22] Filed: Mar. 10, 1988

[30] Foreign Application Priority Data

Mar. 11, 1987 [JP] Japan ..... 62-54072

[51] Int. Cl.[4] ..... G09G 1/06

[52] U.S. Cl. ..... 340/723; 340/732; 340/789; 340/798; 340/799

[58] Field of Search ..... 340/723, 732, 733, 736, 340/744, 745, 789, 798, 799, 800, 801, 802, 803, 804; 358/21 R, 27, 41, 75, 280, 284; 364/518, 521

[56] References Cited

U.S. PATENT DOCUMENTS

| | | | |
|---|---|---|---|
| 4,401,985 | 8/1983 | McVey et al. | 340/744 |
| 4,616,336 | 10/1986 | Robertson et al. | 340/723 |
| 4,626,902 | 12/1986 | Yamada | 358/75 |
| 4,661,841 | 4/1987 | Suzuki | 358/27 |
| 4,672,369 | 6/1987 | Preiss et al. | 340/723 |
| 4,701,864 | 10/1987 | Takashima et al. | 340/723 |
| 4,758,883 | 7/1988 | Kawahara et al. | 358/41 |

FOREIGN PATENT DOCUMENTS

| | | |
|---|---|---|
| 58-220588 | 12/1983 | Japan . |
| 59-228476 | 12/1984 | Japan . |
| 62-108282 | 5/1987 | Japan . |

*Primary Examiner*—David K. Moore
*Assistant Examiner*—Richard Hjerpe
*Attorney, Agent, or Firm*—Fleit, Jacobson, Cohn, Price, Holman & Stern

[57] ABSTRACT

An image data output apparatus having a plurality of memories, a plurality of latch circuits corresponding in number to the memories, a data selector, and a timing pulse generator. A plurality of pixel data corresponding to a plurality of pixels constituting an image are stored in the memories. A plurality of read clock signals having different timings are supplied from the timing pulse generator to the memories to read pixel data from the memories at different timings. The read-out pixel data are applied at different timings to the latch circuits. A plurality of latch signals having different timings are supplied from the timing pulse generator to the latch circuits to thereby make definite the pixel data at the latch circuits at different timings. The definite pixel data are supplied to the data selector to which a select signal from the timing pulse generator is applied. Thus, the pixel data are sequentially outputted one after another from the data selector.

4 Claims, 5 Drawing Sheets

IMAGE DATA OUTPUT APPARATUS

BACKGROUND OF THE INVENTION

1. Field of the Invention

The present invention relates to an image data output apparatus, and more particularly to an image data output apparatus for sequentially outputting one after another a plurality of pixel data stored in a memory. More specifically, the present invention relates to an image data output apparatus wherein: a plurality of read clock signals from the timing pulse generator are sequentially applied one after another to a plurality of memories to read each one of a plurality of pixel data corresponding to a plurality of pixels constituting an image; a plurality of read-out pixel data are applied to latch circuits to latch them upon application of latch signals from the timing pulse generator to the latch circuits; and a plurality of latched pixel data are applied to a data selector to serially output the plurality of latched pixel data therefrom upon application of data selector signals from the timing selector to the data selector.

2. Related Background Art

According to a conventional technique, the following processing has been performed: An image is divided, for example, into m rows in the horizontal direction and n columns in the vertical direction to obtain a plurality of pixel groups. Each pixel group has i pixels, and i memories corrsponding in number to that of the pixels included in a pixel group are provided. Each of the i pixels is converted into one bit (binary) image data for example. The i image pixel data are called a unit. Each pixel data in a unit is stored in a corresponding one of the i memories. In reproducing an image, i pixel data constituting a first unit are first read out of the i memories. The read-out i pixel data are serially outputted one after another. Subsequently, the pixel data in second and third units are subjected to similar processing as above, to thereby serially output all of the pixel data one after another. In accordance with the pixel data serially outputted one after another, an image is reproduced and displayed on a CRT, for example.

FIG. 5 shows an image data output apparatus to be used for the above-described processing to output pixel data one after another. In this apparatus, i is assumed to be "4". Thus, four memories 1 to 4 are provided together with a timing pulse generator 5, a latch circuit 6 and a data selector 7 from which pixel data are serially outputted one after another. Particularly, the timing pulse generator 5 generates a read clock signal R as shown in FIG. 6(A) to supply it to the memories 1 to 4. The pixel data are accordingly outputted from the memories 1 to 4 at the leading edge of the read clock signal R the pixel data being outputted thereafter from the data selector 7. The pixel data read from the memories 1 to 4 are as shown in FIGS. 6(B) to 6(E). In the Figures, Mx,y corresponds to a pixel data of the y-th data in a memory x.

The pixel data read out of the memories 1 to 4 are supplied to the latch circuit 6 and latched at the leading edge of a latch signal L shown in FIG. 6(F). The latched pixel data are supplied to the data selector 7 which selectively and sequentially outputs the latched pixel data one after another. A select signal S supplied from the timing pulse generator 5 as shown in FIG. 6(G) determines from which memory a pixel data is outputted. When select signal S shown in FIG. 6(G) is supplied, the data selector 7 outputs pixel data D at the timings shown in FIG. 6(H).

With the above mentioned apparatus, however, if the frequency of the read clock signal R becomes high and the read timings become high speed, then the time from the leading edge of the latch signal L to the time when the output data form the latch circuit 6 becomes definite, i.e., the time period during which the output data is indefinite, becomes non-negligible as compared to the output time required for one pixel data. Thus, the processing capability of the data selector 7 cannot follow it. Consequently, if the read timings of the conventional apparatus become high speed, pixel data which should not be outputted are outputted, resulting in a poor reproduced image.

SUMMARY OF THE INVENTION

The present invention has been made in view of the above problems. It is an object of the present invention to provide an image data output apparatus capable of operating correctly and outputting proper pixel data one after another even at a high speed timing of reading the pixel data form memories.

An image data output apparatus of this invention has an organization as described below. In the image data output apparatus described below, a plurality of latch circuits corresponding in number to that of the plurality of memories are provided, each of the plurality of latch circuits being supplied with pixel data from a corresponding one of the plurality of memories, and wherein a plurality of read clock signals are outputted from the timing circuit at different timings to respective memories, and a plurality of latch signals are outputted from the timing circuit at different timings to respective latch circuits.

DETAILED DESCRIPTION OF THE PREFERRED EMBODIMENTS

Figure 1:
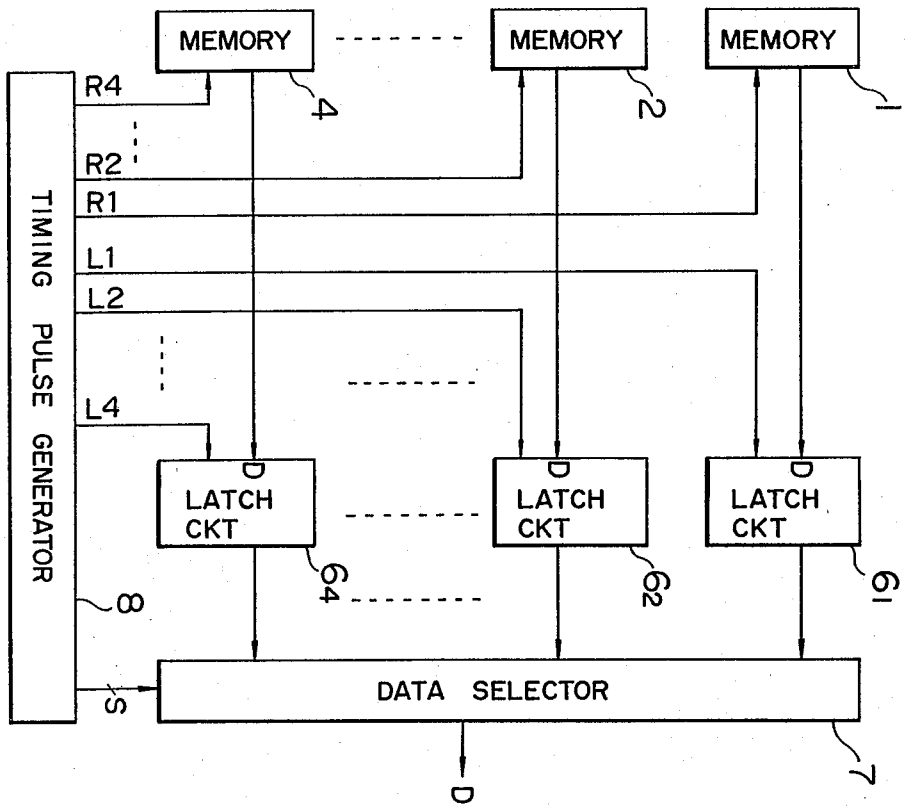
FIG. 1 is a block diagram showing an embodiment of an apparatus of the present invention.
Figure 5:
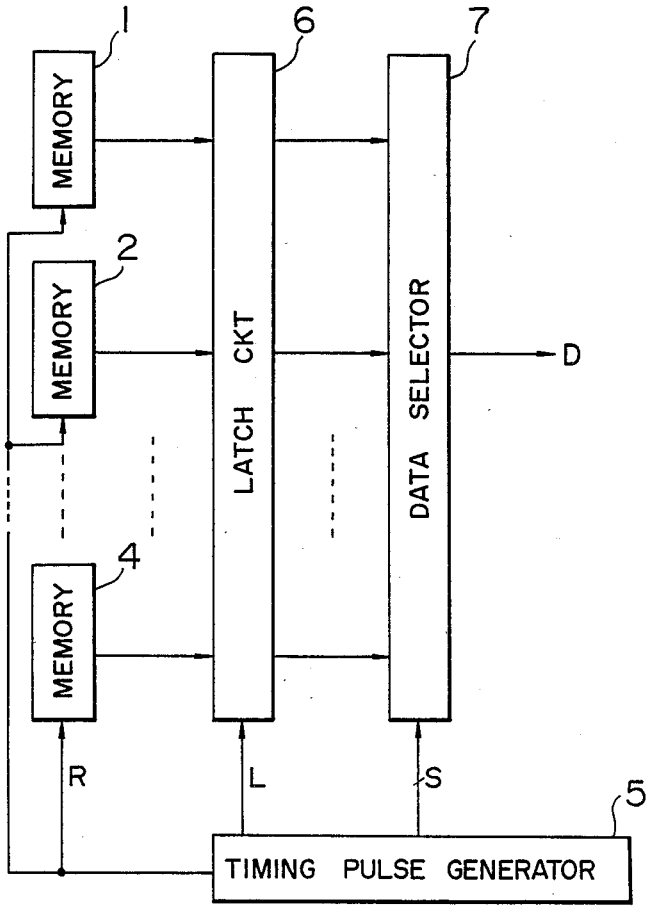
FIG. 5 PRIOR ART
FIG. 5 is a block diagram showing an example of a conventional apparatus.
Figure 6:
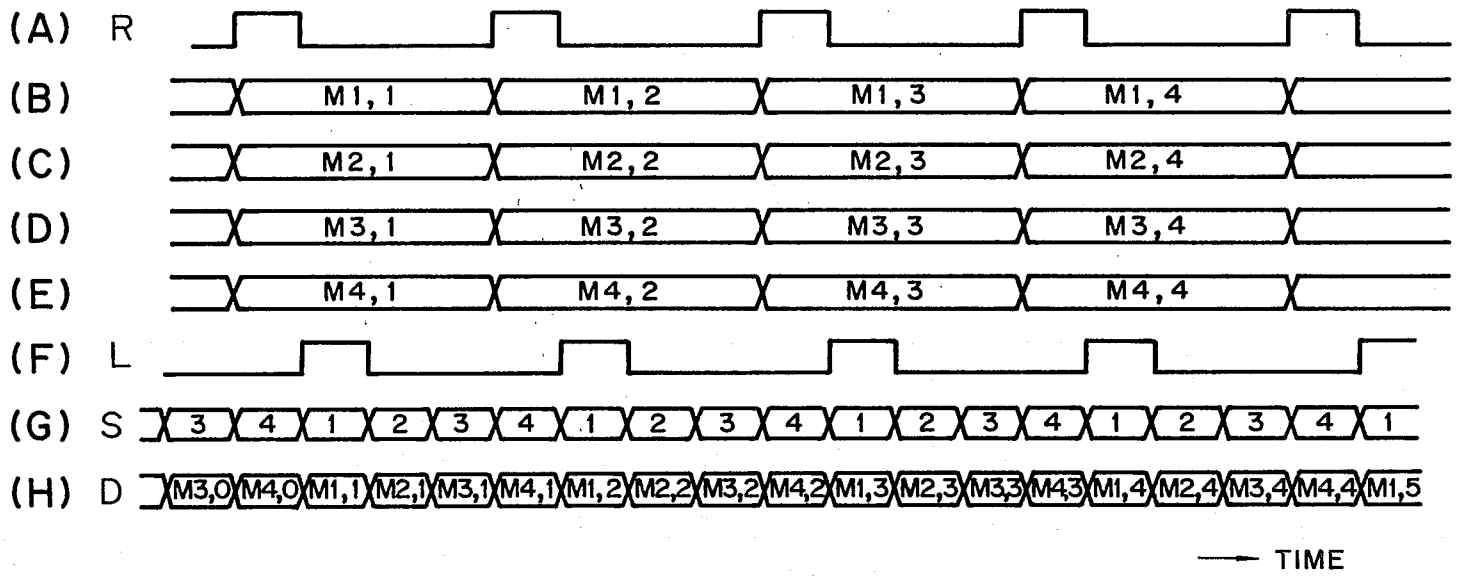
FIG. 6 PRIOR ART
FIG. 6 is a timing chart for a description of the operation of the apparatus shown in FIG. 5.

FIG. 1 is a block diagram showing an embodiment of an apparatus according to the present invention. In the Figure, similar elements to those shown in FIG. 5 are designated by using identical numbers and repeated description thereof will be omitted. Each of the memories 1 to 4 is preferably of a type in which serial access —i.e., read-out address being automatically incremented by a read clock signal—is possible. In this example, a timing pulse generator 8 supplies read clock signals R1 to R4 shown in FIGS. 2(A) to 2(D) to associated memories 1 to 4, the timings of the read clock signals R1 to R4 being displaced or offset relative to each other as seen from FIGS. 2(A) to 2(D). Therefore, pixel data stored beforehand in the memories 1 to 4 are read at timings shown in FIGS. 2(E) to 2(H). Each pixel data read from the memories 1 to 4 is supplied to associated latch circuits $6_1$ to $6_4$. The timing pulse generator 8 also supplies latch signals L1 to L4 with timings as shown in FIGS. 2(I) to 2(L) to associated latch circuits $6_1$ to $6_4$. Each pixel data latched at the latch circuits $6_1$ to $6_4$ is supplied to a data selector 7 in a manner similar to that of a conventional apparatus. A select signal S shown in FIG. 2(M) from the timing pulse generator 8 is being supplied to the data selector 7 so that pixel D shown in FIG. 2(N) are outputted from the data selector 7.

Figure 2:
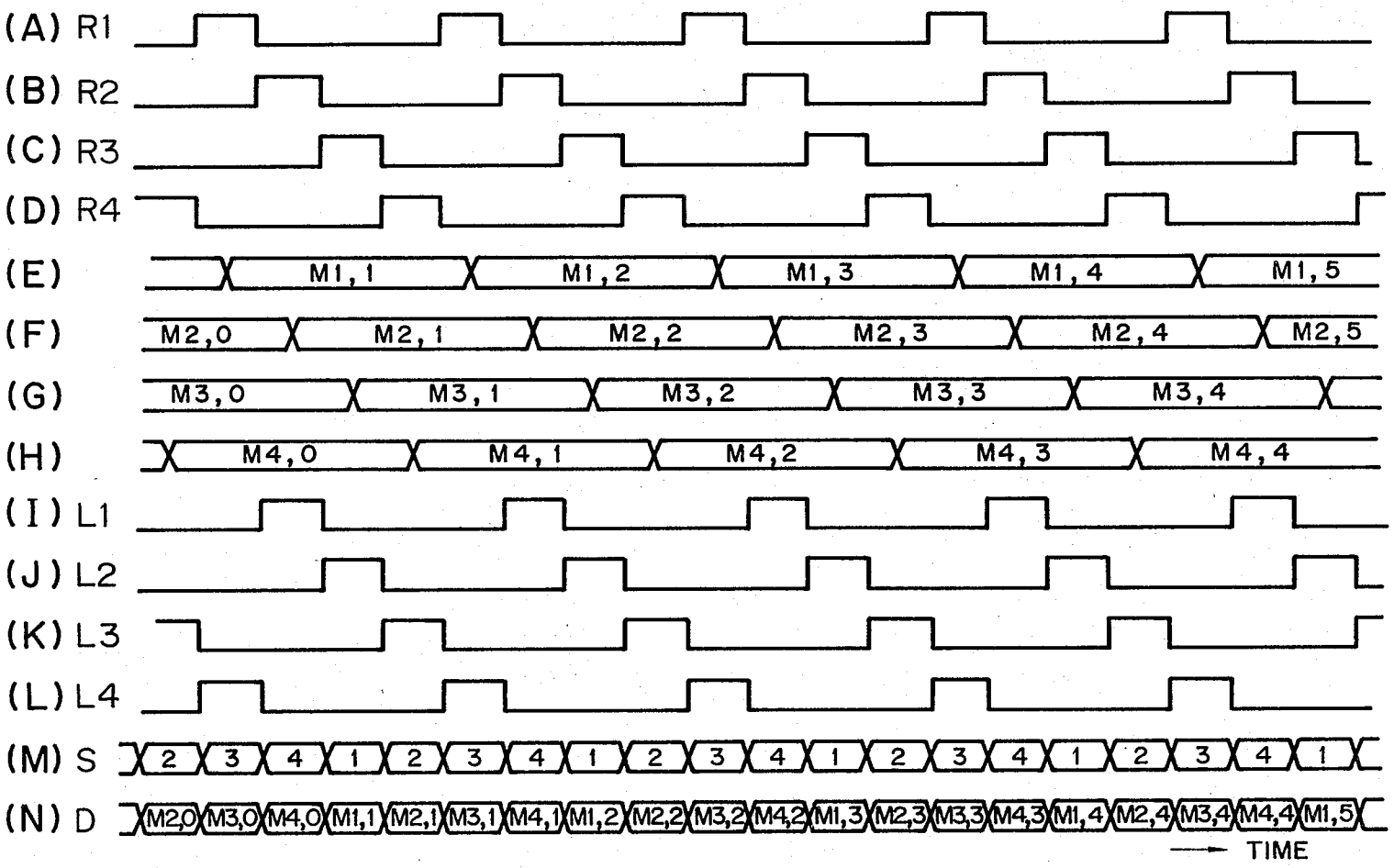
FIG. 2 is a timing chart for a description of the operation of the apparatus shown in FIG. 1.

The timings of the read clock signals R1 to R4 supplied to the memories 1 to 4 are displaced relative to each other as shown in FIG. 2. The latch signals L1 to L4 supplied to the latch circuits $6_1$ to $6_4$ are also displaced relative to each other. And further, the timings of the read clock signal Ri (i =1, 2, 3 or 4) for reading out a datum, the latch signal Li for latching that datum and the select signal S for selecting that datum are displaced relative to each other. Thus, even at high speed read timings, the time when output data becomes definite at the latch circuit, i.e., the time period during which the output data is indefinite, can substantially be neglected as compared to the time required for outputting one pixel data. That is, the processing capability of the data selector 7 can follow such a high speed operation. As described previously, although a conventional apparatus has a problem in that pixel data which should not be outputted are outputted, thereby resulting in a poor reproduced image, the apparatus of this example can eliminate this problem.

Figure 3:
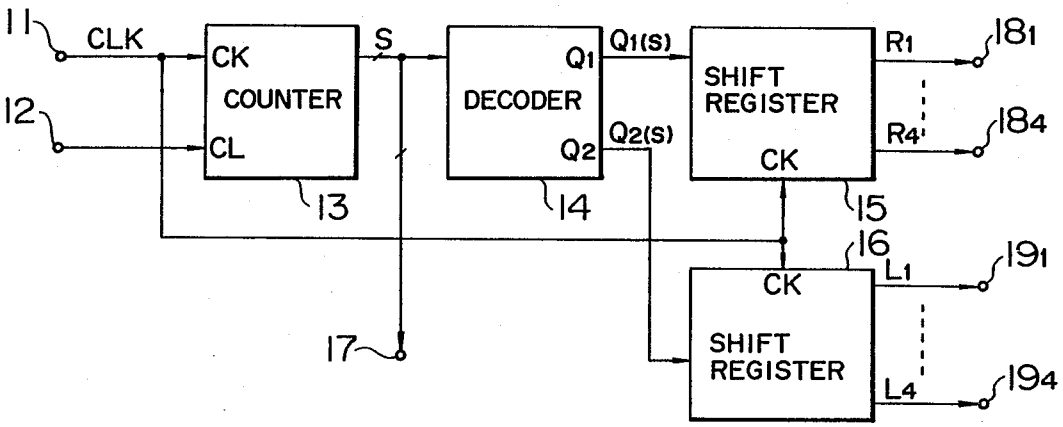
FIG. 3 is a circuit diagram in block form showing an example of the timing pulse generator of the apparatus shown in FIG. 1.

Next, an example of the timing pulse generator 8 will be described with reference to FIG. 3. The timing pulse generator 8 is provided with a counter 13, a decoder 14 and shift registers 15 and 16. The counter 13 shown in FIG. 3 is a quarternary counter. In the case where i is n, an n-nary counter may be sed.

Figure 4:
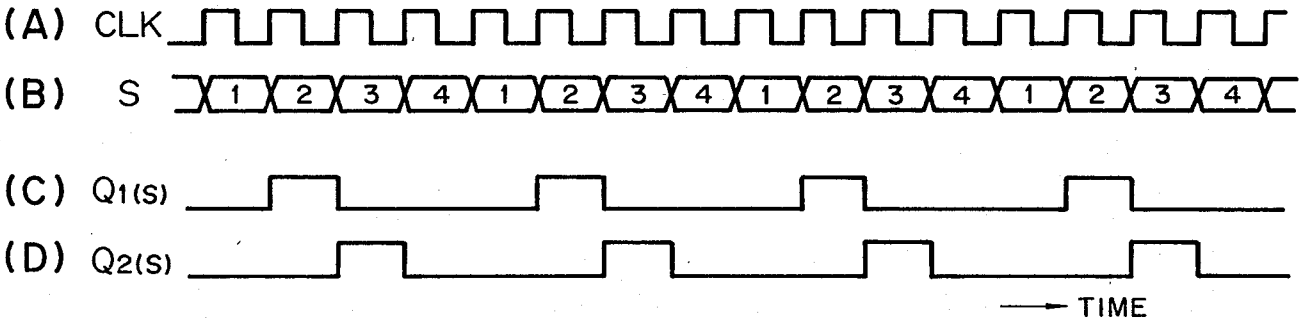
FIG. 4 is a timing chart for a description of the operation of the timing pulse generator shown in FIG. 3.

Main clock signal CLK for display purpose shown in FIG. 4(A) is applied via a terminal 11 to a clock terminal CK of the counter 13 which counts them. The frequency of the main clock signal CLK is equal to that used for displaying one pixel. No image is displayed on a screen during a horizontal blanking period. To this end, a horizontal blanking signal is supplied via a terminal 12 to a clear terminal C of the counter 13 during the horizontal blanking period to thereby stop the count operation by the counter 13. An output signal (select signal S) from the counter 13 is sent to a terminal 17 and also supplied to the decoder 14. A select signal S from the counter 13 is shown in FIG. 4(B).

The decoder 14 outputs a signal Q1 (S) shown in FIG. 4(C) from its first output terminal Q1 when the count value (select signal S) of the counter 13 takes a first value ("2"), and outputs a signal Q2 (S) shown in FIG. 4(D) from its second output terminal Q2 at a second value ("3"). Signal Q1 (S) from the first output terminal Q1 of the decoder 14 is supplied to the shift register 15, while signal Q2 (S) from the second output terminal Q2 of the decoder 14 is supplied to the shift register 16. To a clock terminal CK of each of the shift registers 15 and 16, main clock signal CLK from the terminal 11 is supplied. Therefore, the shift register 15 delays the signal Q1 (S) in response to main clock signal CLK to output read clock signals R1 to R4 from terminals $18_1$ to $18_4$ by delaying the signal Q1 (S) by 1 to 4 CLK clock pulses. Similarly, the shift register 16 delays the signal Q2 (S) in response to main clock signal CLK to output latch signals L1 to L4 from terminal $19_1$ to $19_4$ by delaying the signal Q2 (S) by 1 to 4 CK clock pulses.

Although four memories and four latch circuits have been used in the example shown in FIG. 1, n memories and n latch circuits are used if i is n. Also, each pixel data may be represented using two or more bits.

In the apparatus shown in FIG. 1, the timings of the read clock signals supplied to the memories are displaced relative to each other, and the timings of the latch signals supplied to the latch circuits are displaced relative to each other. Therefore, data selection by the data selector even at a high speed data reading timing is always accomplished after output data from the latch circuit becomes definite. Further, as described with reference to FIG. 3, the timing pulse generator is realized by the use of a simple circuit arrangement having a shit register, wherein main clock signal pulses for display purpose having a frequency identical to that used for displaying one pixel are counted, and decoded count signals are shifted at the shift register in response to the main clock signal to obtain read clock signals and latch signals.

What is claimed is:

1. A image data output apparatus wherein a plurality of read clock signals from a timing pulse generator are sequentially applied one after another to a plurality of memories to read out therefrom each one of a plurality of pixel data stored therein corresponding to a plurality of pixels constituting an image, said plurality of read-out pixel data are applied to latch circuits to latch said read-out pixel data upon application of latch signals from the timing pulse generator to the latch circuits, and a plurality of said latched pixel data are applied to a data selector to serially output the plurality of latched pixel data therefrom upon application of data selector signals from the timing pulse generator to the data selector, the:

a plurality of said latch circuits corresponding in number to that of the plurality of said memories are provided, each of the plurality of latch circuits being supplied with pixel data from a corresponding one of the plurality of memories, a plurality of read clock signals are outputted from said timing pulse generator at different respective timings, each respective one of said plurality of read clock signals being applied to a respective one of said plurality of memories, and a plurality of respective latch signals are outputted from said timing pulse generator at different respective timings, each respective one of said plurality of latch signals being applied to a corresponding respective one of said plurality of latch circuits.

2. An image data output apparatus according to claim 1, wherein said data selector signals from said timing pulse generator are applied to said data selector after said plurality of pixel data become definite at said plurality of latch circuits.

3. An image data output apparatus according to claim 1, wherein said timing pulse generator comprises:

a counter for counting a main clock signal for display purposes having a frequency identical to that used for displaying one pixel, a decoder for respectively outputting a first decoded signal (Q1) and a second decoded signal (Q2) when a count value of said counter respectively takes a first predetermined value and a second predetermined valuel which is more than the first predetermined value, a first shift register (15) for generating said plurality of read clock signals at different respective timings by delaying said first decoded signal for every one clock cycle of said main clock signal, and a second shift register (16) for generating said plurality of latch signals at different respective timings by delaying said second decoded signal for every one clock cycle of said main clock signal.

4. An image data output apparatus according n to claim 3, wherein said counter has a clear terminal to which a horizontal blanking signal is applied for stopping the count operation of said counter during a horizontal blanking period.

* * * * *